United States Patent [19]

Mourrellone

[11] Patent Number: 4,542,693

[45] Date of Patent: Sep. 24, 1985

[54] INKING METHOD AND DEVICE FOR PRINTING MACHINE

[76] Inventor: Georges Mourrellone, 37 Lot. des Queuilles, Orcet F 63670 Le Cendre, France

[21] Appl. No.: 572,748

[22] PCT Filed: May 10, 1983

[86] PCT No.: PCT/FR83/00090

§ 371 Date: Jan. 10, 1984

§ 102(e) Date: Jan. 10, 1984

[87] PCT Pub. No.: WO83/04003

PCT Pub. Date: Nov. 24, 1983

[30] Foreign Application Priority Data

May 10, 1982 [FR] France ..... 8208107

[51] Int. Cl.[4] ..... B41F 31/04; B41F 31/06; B41L 27/08

[52] U.S. Cl. ..... 101/350; 101/365

[58] Field of Search ..... 101/350, 363, 148, 365, 101/207–210, 349

[56] References Cited

U.S. PATENT DOCUMENTS

| | | | |
|---|---|---|---|
| 3,026,795 | 3/1962 | Dietrich | 101/148 |
| 3,566,787 | 3/1971 | Moos | 101/350 |
| 3,585,932 | 6/1971 | Granger | 101/350 |
| 3,978,788 | 9/1976 | Cappel et al. | 101/363 |
| 4,041,864 | 8/1977 | Dahlgren et al. | 101/350 |

FOREIGN PATENT DOCUMENTS

| | | | |
|---|---|---|---|
| 639293 | 12/1936 | Fed. Rep. of Germany | 101/350 |
| 1344700 | 9/1963 | France . | |
| 2242852 | 3/1975 | France . | |
| 871786 | 6/1961 | United Kingdom | 101/148 |
| 1267947 | 3/1972 | United Kingdom | 101/350 |

*Primary Examiner*—J. Reed Fisher

*Attorney, Agent, or Firm*—Fleit, Jacobson, Cohn & Price

[57] ABSTRACT

Method for applying a thin film of a high viscosity liquid to a moving surface by means of an inking roller having a flexible outer cover and that is in contact with other rollers. A layer of predetermined thickness of the liquid is deposited on a supply roller having a tangential speed relatively slower than that of the inking roller. The supply roller supplies liquid over a contact area of the contacting rollers and the liquid product is transferred and spread into a thinner layer on the inking roller, either directly or indirectly.

11 Claims, 13 Drawing Figures

INKING METHOD AND DEVICE FOR PRINTING MACHINE

The invention relates to inking of printing machines with greasy ink.

The principal problem posed by the inking of an offset or letterpress press consists of depositing in a regular manner, from a body of greasy ink, a layer of a few microns thickness uniformly spread on the printing parts of a plate impression cylinder. The ink so deposited on the cylinder is then transferred on to the paper, either directly in the case of letterpress printing, or indirectly, by the intermediary of a cylinder covered with a layer of rubber called a blanket in the case of offset printing.

The main inking arrangements have numerous inconveniences, notably a complex mechanism which is comprised essentially of a very hard steel roller scraped by a steel blade called a scraper, the greasy ink being included between this roller and its scraper. A large number of adjusting screws spread along the length of this scraper permit adjustment with the best possible precision of the space between the roller and the edge of the scraper, thus allowing passage of more or less ink according to the degree of tightening of each screw. This assembly called "an inker" distributes the ink in the direction transverse to the paper.

The quantity of ink freed by each screw ought to correspond to the consumption of ink taken by each transverse zone of the paper. For example, if the printing has many printed bands in the longitudinal direction and separated transversely by spaces remaining blank, the adjusting screws of the inker ought to be adjusted tight in the blank zones and more or less open in the printed zones, according to the intensity of colour of these bands.

From this inking roller and scraper are arranged in contact with each other a battery of rollers covered with rubber or plastic of which certain have a transverse oscillating movement for helping the distribution of the ink. This battery is provided with two to four rubberised rollers called "inking rollers" which are in contact directly with the printing cylinder.

In fact, in the case of letterpress one has a printing cylinder in direct contact with the paper, held by a free cylinder called an "impression cylinder", and in the case of offset printing one has two cylinders of which a plate cylinder and a transfer cylinder in contact with the paper, always held under pressure by an impression cylinder. In the case of "wet offset" these two cylinders are completed by a more or less complex damping arrangement.

The quantity of ink to be deposited on each printed zone must be extremely precise if one wishes to preserve uniform colouring. On the contrary, in the transverse direction, the screws of the inker permit an approached adjustment, obtained by successive approximations, which causes significant losses of paper. Certain manufacturers have gone to the extent of motorising each screw by means of small motors controlled step by step from a console, either manually or from measurements of the density of colour made continuously on the sheet produced by means of complex electronic systems.

In the longitudinal direction no adjustment is possible. Thus a zone inked with a strong consumption of ink preceded by a blank zone will appear more pronounced than a continuously inked zone juxtaposed to the former. This is a frequent example in the case of printing of a frame. In effect, during the production of a blank zone there will be an accummulation of ink in the roller. When the inked zone which follows comes in contact with the over-inked inking rollers, it receives more ink than the neighbouring zone and appears darker. This phenomenon is well known to offset printers and is called a "set-off".

Only the provision of the inking battery, by multiplication of the number of rollers and by certain arrangements, permits reduction of this phenomenon.

It results from the above that the complexity of the mechanism and the electronic circuits result in significant investments which can only be amortised over long runs. In effect, the times for adjustment are raised, from 2 to 8 hours for 4 colours and the operation of such devices requires highly specialised personnel and an often onerous maintenance. To the significant losses due to the length and hourly cost of fixed charges of the machine during adjustment must be added the cost of wasted paper.

Attempts have been made at remedying this situation, particularly in the form of inkings called "shorts" principally shown by the French Pat. No. 1341700. The devices of this type have generally included only a very reduced number of rollers transmitting the ink to the printing plate. Their object is to deposit on the inking roller a uniform thickness of ink e, renewed immediately, in order that the printing parts of the plate cylinder always lift the same thickness of ink from the inking roller, whatever their surface and their disposition. This is in order to overcome at the same time the mechanical complexity as well as the problems of the "set-off" and the adjustment of the screws of the inker.

For better understanding of the invention, details of the most relevant prior art will now be explained, with reference to the accompanying drawings, in which:

FIG. 1*a* shows schematically a short inking according to the method of French Pat. No. 1341700;

FIG. 1*b* shows in the usual manner the developed scheme of the inking roller showing the succession of operations effected at its periphery;

FIGS. 2 and 3 show developed schemes corresponding respectively to the variants described in the above patent and in its first Certificate of Addition;

FIG. 4*a* shows schematically another arrangement of short inking described in the French Pat. No. 7339429;

FIG. 4*b* shows the developed scheme of the inking roller corresponding to FIG. 4*a;*

Figure 1A:
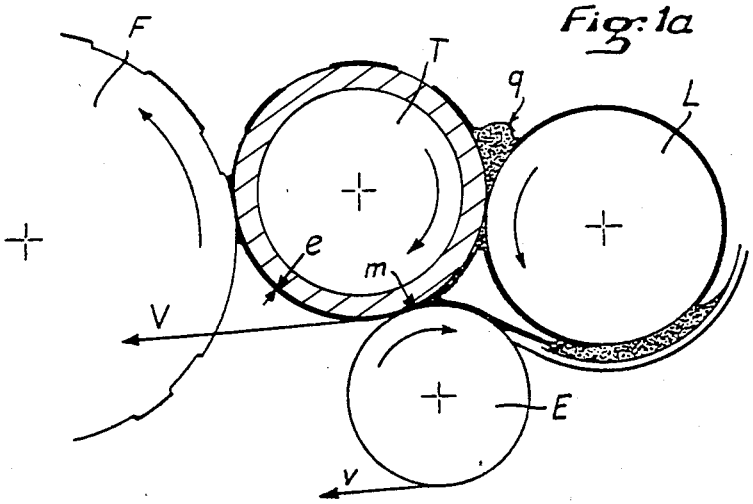

Returning to the short inking according to the state of the art described by the French Pat. No. 1341700 and shown on FIG. 1*a,* one sees that a quantity q of greasy ink is included between the inking roller T and a laminating roller L turning in the reverse direction, as shown by the arrows. The ink then finds itself "laminated" between the two rollers, but the thickness of the film which results is too high to be used directly.

The wiper roller E is held under pressure onto the inking roller T covered with a flexible material. These two rollers turn in the same rotary direction with the result that the film of ink included in the contact zone m finds itself driven in one direction by the roller E and in the other direction by the inking roller T. The film is thus sheared in its thickness.

There results a thickness of ink e on the inking roller T independent of the quantities of ink not used upstream of the zone m. The excess of the sheared ink at the point m is removed by the roller E and taken up again by the roller L which returns it to the reserve q contained in the inker.

Figure 1B:
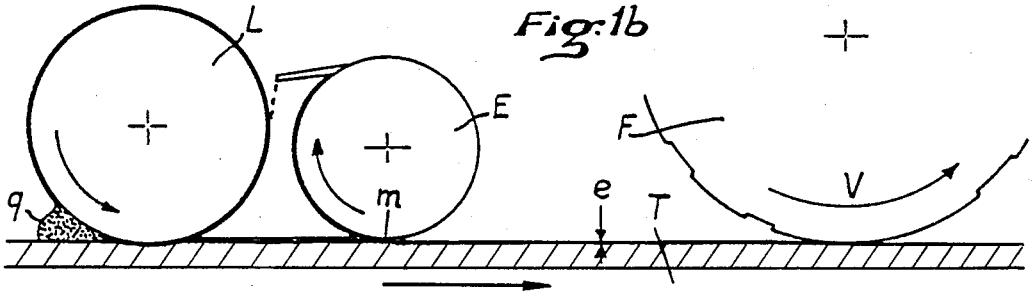

On the developed scheme of FIG. 1*b* the paths taken by the quantities of ink may be seen.

Figure 2:
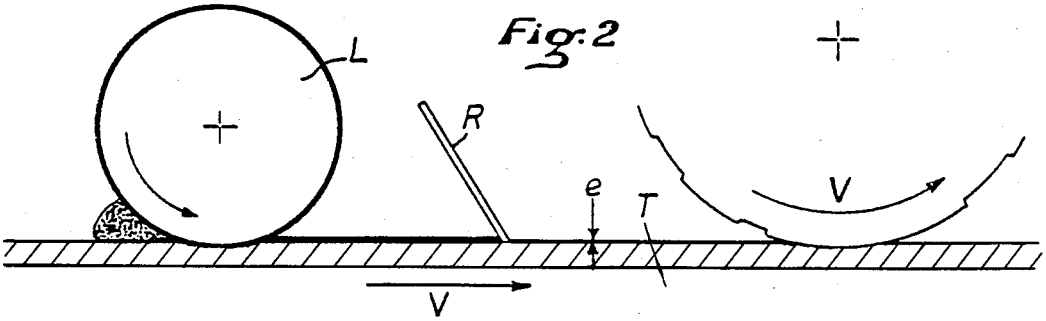

In the variant described in the abovementioned patent and shown in FIG. 2, the wiping roller E has been replaced by a scraper R.

Figure 3:
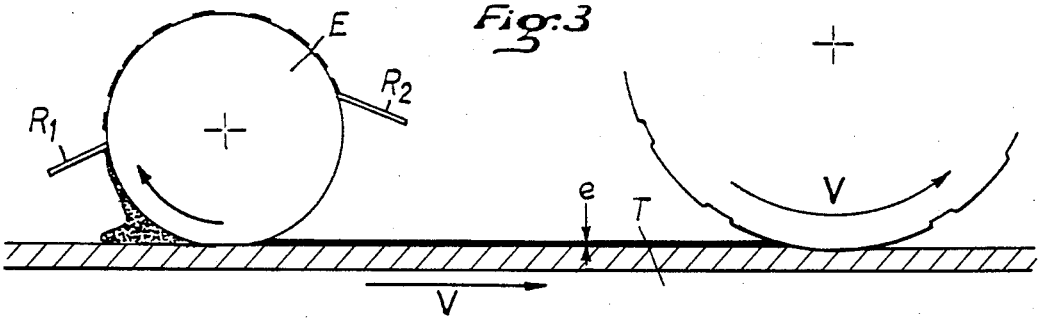

FIG. 3 shows the variant corresponding to the first Certificate of Addition of the patent referred to. The laminating roller L has been removed and the wiping roller E remains, but for avoiding return of the ink coming from the reservoir on the sheared film two scrapers R1 and R2 have been arranged which clean the surface of the wiping roller E before this enters in contact with the film spread on the inking roller T.

The inconveniences of this method of short inking according to the mentioned patent and its addition are set out in the preamble to French Pat. No. 7339429 (2.242.852) claiming priority from Swiss application No. 12 278/73. In summary, experience shows that the devices cannot function because the thickness e of the ink film is approximately three times too great with the viscosities of inks necessary for a correct printing. Consequently the roller E has been turned at high speeds incompatible with the quality possible of the adjustments of the scraper, the drive gears, the out of roundness of the roller, etc., to such extent that the short inking devices of this type have not been able to be used industrially up until now.

Figure 4A:
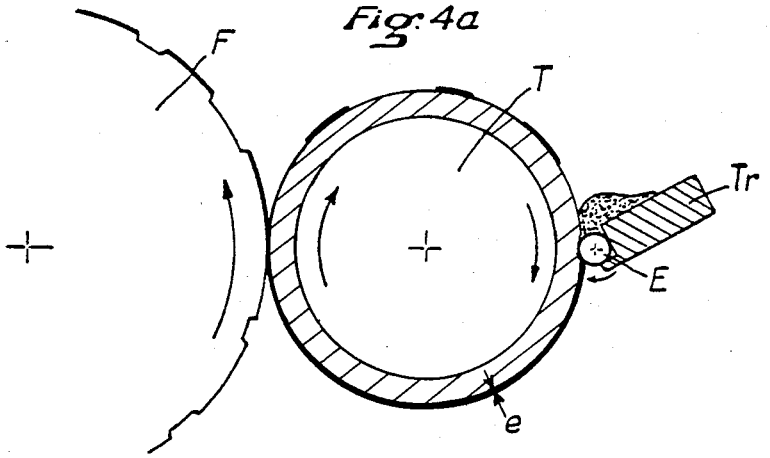
Figure 4B:
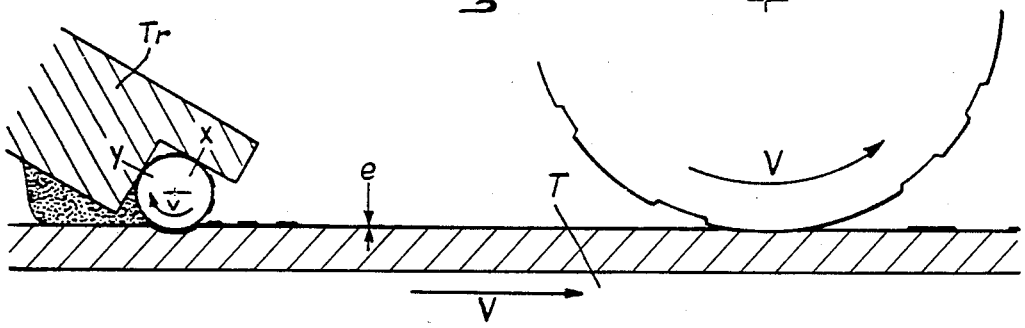

The device described in the last patent mentioned is shown in FIG. 4*a*. With respect to the preceding devices, the wiping roller E has been reduced in diameter for augmenting the pressure on the ink film and reducing the thickness. This roller thus becomes a shaft, still referenced E, which is maintained under pressure along its entire length against the inking roller T by a V-groove in a transverse member Tr. Also the scrapers R1 and R2 of the preceding device are replaced by tangents x and y at the points of contact of the shaft E and its support Tr as shown in the developed scheme of FIG. 4*b*. The lines of contact are supposed to prevent the ink from passing and increasing the sheared film of thickness e.

The inconveniences of this last device are the following:

the thickness of the ink film e is several microns. A variation of 10% of this thickness causes a variation visible to the eye of the optical density of the printed product. One may then imagine that the lines x and y must be perfectly tight or let pass only a miniscule ink film of constant thickness, which film is added to the film e of the sheared ink.

In fact, when the system is new, it is practically impossible to obtain at close to one micron a perfect regularity of this parasitic film. More or less deep stripes appear in the printing. At the same time, impurities, dust, or even certain abrasive pigments obtained in the ink, cause a more or less regular lapping and the lines of contact become progressively curved surfaces more or less scratched. Independently of the stripes which can be caused, the increase of the surface zones of contact x and y provoke a diminution of the unitary pressure of the shaft E against its support Tr with a consequent increase in thickness of the parasitic film.

When the speed of the machine increases, it is necessary to increase the speed of the wiping shaft for maintaining constant thickness e. At the same time the thickness of the parasitic film increases, by dynamic drive, thus producing the opposite effect to that desired. This defect is usually compensated by increasing the penetration of the roller into the inking roller. The pressure is thus increased but at the same time the wear of the flexible surface of the inking roller is increased.

Theory and practice show that beyond a certain penetration of the shaft into the inking roller, there is no further diminution of e. It is the same for the influence of speed, because if one calls v the tangential speed of the wiping roller or shaft E and V the tangential speed of the inking roller, above a certain value of the ratio v/V, e decreases no further.

The major inconvenience of this method of inking is then the limitation of the printing speed to values 8 to 10 times lower than traditional methods.

Another inconvenience is the rapid wear of moving parts and the impossibility of assuring correct tightness at the ends of the transverse member Tr. In fact, this tightness is in principal assured by two cheeks traversed by the shaft and resting both on the side of the inking roller T and on the transverse member Tr. At the intersection of these elements, of which one, T is flexible and deformed by penetration of the shaft, one or more interstices are produced in which the ink flows, causing different mackles.

Similarly at low speed, it is necessary to permanently readjust the speed of the shaft for maintaining constant thickness e as a result of variations of temperature of ink at the point of laminating.

Figure 5:
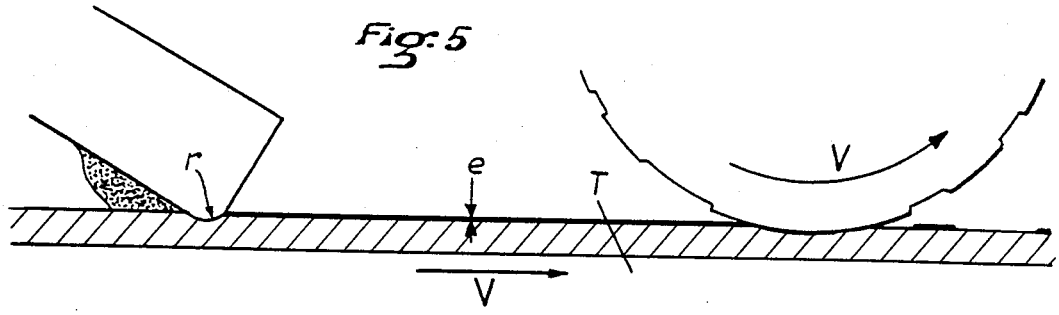
FIG. 5 shows a particular case of this device.

In the last patent mentioned, there is also provided a variant shown in FIG. 5. In this case the shaft E does not turn and can be replaced by a cylindrically curved surface of radius r maintained under pressure on the inking roller T. The thickness of sheared ink e then depends on only two factors, namely the radius r and the penetration, apart from the usual factors such as the viscosity of the ink, the durability of the flexible covering and the speed V. When the speed increases, it is then necessary to increase the penetration. The limit is determined by the wear of the surface of the inking roller.

For the same reasons as given above, there is wear of the cylindrical part of which the radius r must be maintained in the region of 0.2 to 0.5 mm. Progressively during printing, the radius r increases by wear and streaks appear in the printing.

In summary, all the prior devices examined propose to obtain on the inking roller a layer of ink of which the constancy of thickness is obtained by shearing between the surface of the inking roller and another surface operated at a very different velocity at the point of contact, either opposed or stationary. In fact this thickness depends on a large number of factors which are difficult to control, to the point that the short inking devices of the different types examined cannot be used industrially to this day at competitive speeds. It is the object of the present invention to eliminate these inconveniences particularly the complexity, the difficulties of adjustment, the limitations in speed and the influences of various perturbations, temperature, viscosity, wear and out of roundness.

For this the invention, like the state of the art, uses a cylindrical inking roller with a flexible surface covered by a thin film of ink and depositing it on the printing plate, this thin film being determined by contact between the inking roller and a rigid roller having a different peripheral velocity. By constrast, whilst in the state of the art the ink is supplied to the point of contact having been carried by the inking roller and partially returned by the rigid roller, denominated for this wiper roller, in the invention on the contrary the ink is supplied in the form of a calibrated film carried by the surface of the rigid roller, denominated for this supply roller, and is spread at the point of contact with the inking roller.

There results then this fundamental difference, that with the state of the art the reduction of thickness e of the ink film at the surface of the inking roller can only be obtained by increasing the speed of the wiper roller, as well as its pressure, in the case of the invention on the contrary, the diminution of thickness e is obtained by reducing the speed of the supply roller without the contact pressure playing a determining role.

The other features of the method and of the device according to the invention will appear in the following description with reference to FIGS. 6 to 11 enumerated above.

In conformity with the invention, the reservoir q of greasy ink is not in contact with the inking roller T but on the contrary with a supply roller A, as appears particularly in FIGS. 6, 7, 8 and 10. This mass q is included between the supply roller A, a knife 1 and two cheeks 2 provided with circular cut-outs for supporting by transversely encasing the cylindrical surface of the supply roller A which is naturally a rigid roller, preferably metallic. The knife 1 is solid with the cheeks 2 by means of micrometer screws 3 permitting adjustment of the distance d, visible in particular in FIG. 9, between the generatrix of the roller A and the ridge of the knife 1 in a very precise manner. For this, the knife is rendered solid, transversely with respect to the axis of the supply roller A, and by the intermediary of screws 3 and a transverse member 4 and two cheeks 2 which support the roller A. In this manner, the distance d is independent of the inevitable out of roundness of this roller.

Figure 9:
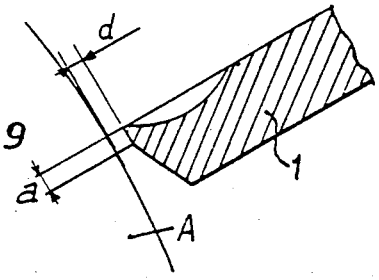
FIG. 9 is a detail on a larger scale of a knife.

The knife 1 is ground in the manner of a cutting tool as shown in FIG. 9, with a small ground flat of length a of approximately a tenth of a millimeter in order that the edge obtained is perfectly straight.

As a result, when the roller A turns, the knife 1 makes a cut in the ink of thickness d, independent of the speed of the roller or the characteristics of the ink. Further the edge of the knife never being in contact with the roller, no wear can result. In practice the thickness d can be varied from 10 to 60 microns in accordance with the precision of the micrometer screws.

The roller A is movable and is maintained under pressure on the inking roller T covered in the usual manner with a coating of flexible material. The differential speed of the surfaces in contact at the point 7 is obtained in this example by a rotation in the same sense of the two cylinders as shown by the arrows in FIG. 6. A scraper 6 eliminates from the periphery of the inking roller T ink not used by the printing block F and deposits it on the supply roller A which returns it to the reservoir q.

If one considers the contact zone 7 between the two rollers A and T, one notes that the quantity of ink which arrives there is equal to the quantity of ink which leaves in the same time.

If one designates by $\epsilon$ the thickness of ink leaving the contact zone 7 on the roller A and if one continues to designate as before by v the peripheral velocity of the supply roller A,
V the peripheral velocity of the inking roller T,
d the thickness of ink determined by the knife 1, and
e the thickness of ink on the inking roller,
the quantity of ink which enters the zone is v.d and that which leaves is $V.e+d.\epsilon$, from which $$e=(d-\epsilon)v/V$$

This shows that $\epsilon$ is practically constant whilst v/V remains less than 1. For an ink of viscosity from 150 to 200 poises, a ratio $v/V=0.5$ and a penetration of the supply roller A into the inking roller T of 0.6 to 0.8 mm, the hardness of the latter being in the region of 50 shores, the thickness $\epsilon$ is approximately 0.5 microns.

By way of example, in the case of offset inking, e must be in the region of 5 microns, which leads to a ratio $v/V=0.2$. The application of the above formula then gives for $d-\epsilon$ the value of 25 microns. Further, a variation of 10% of the thickness $\epsilon$, say, 0.05 microns, gives a variation of 0.2% of the thickness of the layer d, causing a corresponding relative variation of the thickness e, that is to say an absolute variation of 0.01 microns, a negligible quantity and not perceptible on the printing. In practice, and with a very good approximation, one can then ignore $\epsilon$ in the above formula and write $$e=d.v/V.$$

One then sees that for varying the thickness e it suffices to vary either d, or the ratio v/V.

The obtaining of the very small thicknesses sought leads then to turning of the supply roller at relatively slow velocities, in contrast to the state of the art explained above and one sees in FIGS. 6 to 8 how the layer of thickness d arriving at the point of contact is spread by licking on the inking roller T in a layer much thinner of thickness e.

Whilst greasy inks are in general very viscous, this licking can provoke little accumulations of ink on the periphery of the inking roller, which can be reduced in a known manner by arranging a roller 8 rolling at the periphery of the inking roller. Nevertheless, this cylinder 8 may be insufficient for eliminating these small accummulations and obtaining a perfectly uniform layer.

Figure 8:
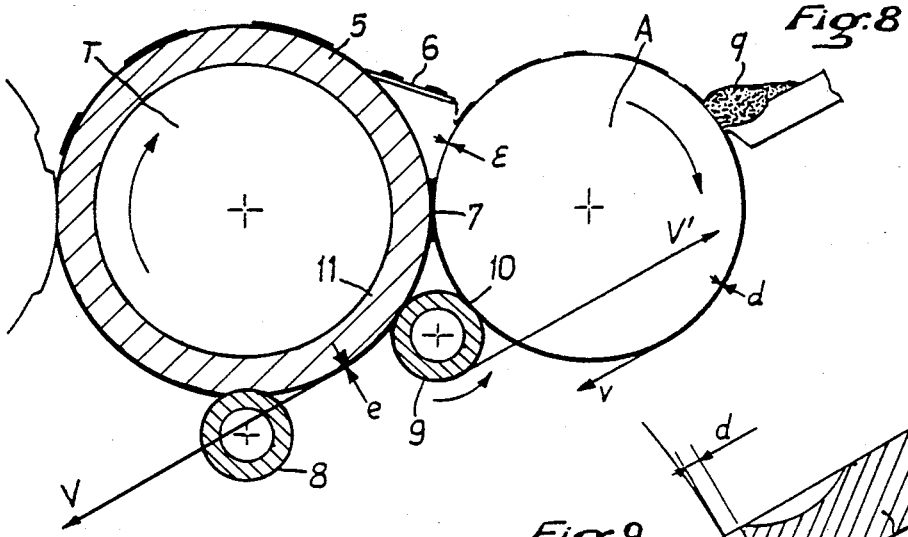
FIG. 8 shows a variant with an equalizing roller.

It is then preferable in accordance with the invention to also arrange an equalizing roller 9 which is driven in the reverse direction to the inking roller at a peripheral speed V' in the region of the peripheral speed V of the inking roller, either by positive gearing, or by simple contact with the inking roller. In addition, this roller 9 is in contact with the supply roller A. Its action does not modify at all the balance of the thicknesses of ink defined by the above formula. As seen in FIG. 8, the layer of ink of thickness d arriving at the zone of contact 10 between the equalizing roller 9 and the supply roller A is divided into two, of which one follows the curved surface of the equalizing roller 9 taking it to the contact zone 11 between the equalizing roller 9 and the inking roller T, and the other follows the curved surface, on the roller A, going from the zone 10 to the zone 7 and then another curved surface on the inking roller T going from the zone 7 to the zone 11. By reason of the differences of speed between V' and v there is a shearing of the layer of ink d in the zone 10, then a laminating in the zone 11. Also, the totality of the thickness e is submitted to an extremely effective lamination at 10, 7 & 11 thus avoiding all agglomeration of the ink at the periphery of the inking roller.

In addition, this equalizing roller 9 can in a known manner be driven with an axial reciprocating movement for improving the regularity of the film of ink and avoiding the formation of possible stripes.

By way of variant, one may imagine that the equalizing roller 9 no longer turns at the speed V' close to V but a speed close to v. In this case, the spreading which was previously produced in the zone 7 (or 10) will be produced in the zone 11, and from this fact it will not be necessary to have the contact between the rollers A and T in the zone 7. In other words, the layer of ink of calibrated thickness d fed at slow speed by the supply roller A can be spread on the inking roller T at a greater peripheral speed either directly in the case originally examined, or indirectly in the case of the variant as has been shown, without departing from the scope of the invention.

It is interesting to note in this context that with the approximation indicated above, the spreading of the layer of ink on the inking roller involves, as has been seen, the product of the calibrated thickness d with the ratio v/V between the supply speed v and the speed of the inking roller V, but this ratio may be taken in arithmetic value or absolute value. In effect, the result is practically the same, that the two tangential speeds v and V may be in the contrary direction as in the first example (which supposes rotations in the same direction), or in the same direction as in the last example (which supposes rotations in the contrary directions).

Thanks to the method of the invention, it may be seen that the value of the thickness e is controlled and becomes independent of the speed of the machine, in which the measurement or the ratio v/V remains constant, and independent of the viscosity of the ink and its temperature, contrary to the state of the art. The apparatus is moreover not sensitive to wear, on account on the one hand of the lack of contact between the knife 1 and the supply roller A, and on the other hand the low speed of rotation of the roller A with respect to the inking roller T. It results that a relatively simple material permits obtaining a high precision of inking and a high working speed compatible with industrial exploitation.

Figure 10:
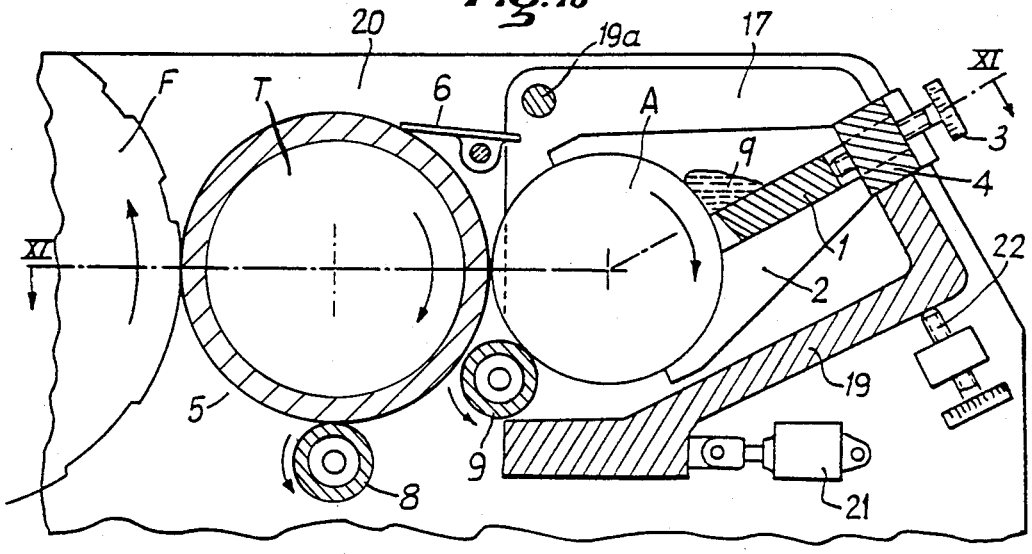
FIGS. 10 and 11 show a particular embodiment of the device, respectively in cross-section on line X—X of FIG. 11, and on line XI—XI of FIG. 10.
Figure 11:
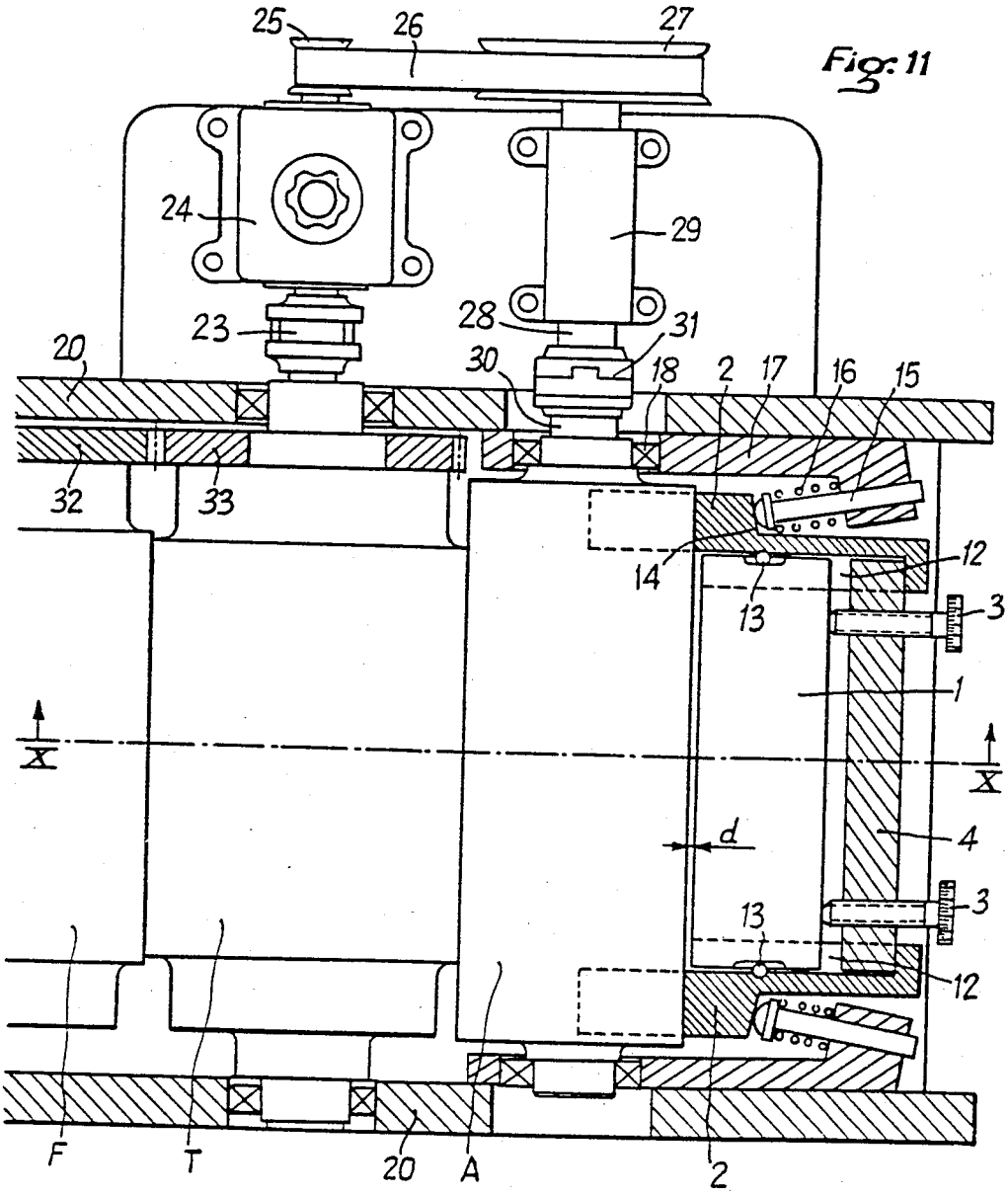
Figure 6:
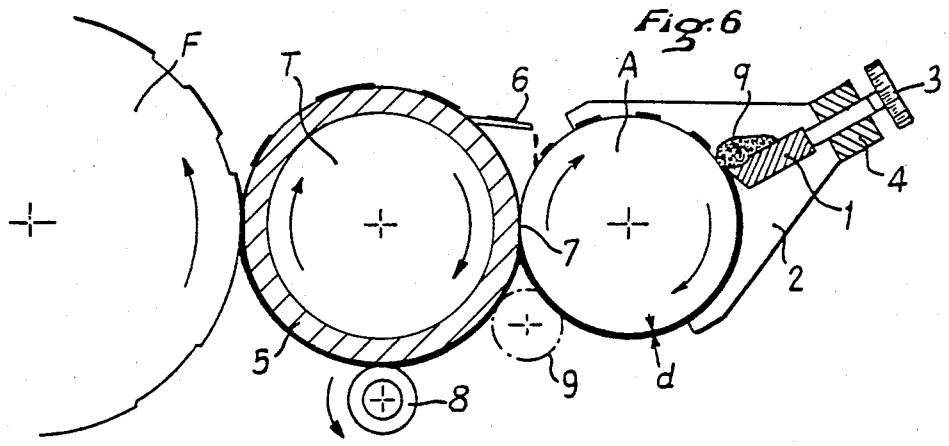
FIG. 6 shows by comparison the general scheme of the method according to the invention.
Figure 7:
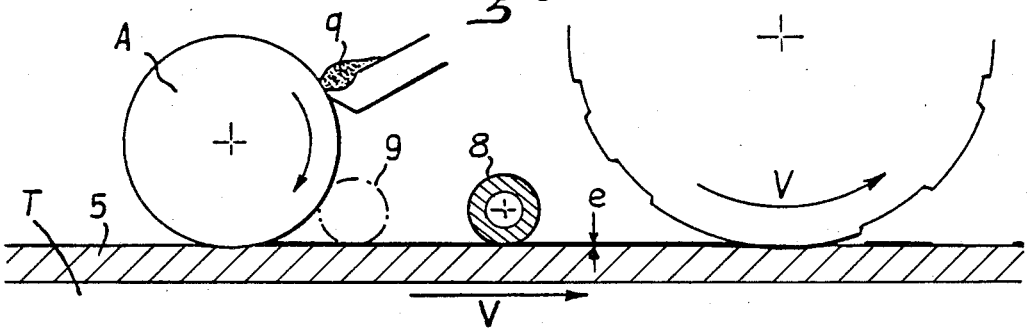
FIG. 7 shows the developed scheme of the inking roller.

For putting into effect the invention, one may use an arrangement shown in more detail in FIGS. 10 and 11.

In this arrangement, the two cheeks 2 are independent and provided on their faces opposite a groove 12 not open towards the exterior, and in which is mounted and supported each at ends of the transverse member 4 carrying the two screws 3, preferably of differential pitch, for micrometer adjustment of the knife 1. This knife 1 is itself guided parallel in the grooves 12 and mounted by means of balls 13 for permitting slight angular adaption of each of the cheeks 2 with respect to the knife 1. Each of the cheeks 2 is supported on the roller A by a part of greater thickness in which is cut a cylindrical cut-out explained above, and this thick part ends with an oblique shoulder 14 on which presses a pusher 15 actuated by a spring 16 and itself sliding in an oblique manner in a side plate 17 having the bearing 18 journalling the roller A, a similar arrangement being provided at the other end of the cylinder. The oblique pushing produced by the pushers 15 on the cheeks 2 produces both their tight application on the periphery of the roller A and their mutual urging together into contact with the balls 13, the tightness between the extremities of the knife 1 and the cheeks being assured by closing of the grooves 12 and by the drive forces. As may be seen particularly in FIG. 10, the two side plates 17 are solid with a cradle 19 pivoting about an axis 19*a* in the frame 20. The penetration of the roller A into the inking roller T is assured by a pushing device 21, constituted by a spring or preferably by a double acting jack permitting application or relief of pressure, and limited in amplitude by an abutment screw 22.

The inking roller T, journalled in the frame 20 to contact the printing plate F, is driven in the opposite direction and at the same tangential speed as the printing plate F by gears 32 and 33. At the end of its shaft 23 is preferably connected a variable speed device 24 permitting adjustment at will of the ratio v/V, and this latter has a drive pulley 25 driving by a belt 26 a larger pulley 27 producing a reduction in the desired direction. This pulley 27 drives a shaft 28 journalled in a fixed block 29 which shaft is connected to the shaft 30 of the supply roller A by a constant velocity joint tolerating movements of the cradle 19.

As also shown in FIG. 10, the scraper 6 and the equalizing rollers 8 and 9 are mounted on eccentrics for permitting adjustment of pressure.

Naturally in addition to the essential applications to printing, the invention can equally be utilised for applying any thin film of viscous liquid, such as paint, glue or the like onto any surface moving by rotation or translation.

I claim:

1. Apparatus for applying a thin film of a high viscosity ink to a rotatable printing plate, said apparatus comprising:

(a) a cylindrical inking roller having a flexible cover adapted to contact a printing plate;

(b) a cylindrical supply roller having a rigid outer surface;

(c) means for causing said supply roller to contact under pressure, said flexible cover of the inking roller along a contact zone;

(d) means for rotating said inking roller in an opposite direction and at the same peripheral velocity as the printing plate and for rotating said supply roller at a peripheral velocity lower than the peripheral velocity of the inking roller;

(e) means for providing on said supply roller and ahead of said contact zone a film of ink having a predetermined thickness from a mass of ink in contact with the surface of the supply roller and not in contact with the inking roller; and (f) means positioned ahead of said contact zone for removing from the periphery of the inking roller ink that remains on the inking roller after it has contacted the printing plate.

2. Apparatus according to claim 1, wherein the means for providing a film of ink on the supply roller includes an elongated knife having an edge substantially parallel to the supply roller and spaced from the outer surface thereof, and wherein the mass of ink is in contact with said knife and said supply roller.

3. Apparatus according to claim 2, wherein a pair of cheek members is provided against said supply roller and in axially spaced reltionship therewith to define the lateral extent of the ink mass.

4. Apparatus according to claim 3, wherein said cheek members include slots to movably receive said knife, and a transverse member extends between said cheek members and carries screw means adapted to bear against an outer edge of said knife and move the same in the direction of said supply roller to permit adjustment of the spacing therebetween.

5. Apparatus according to claim 4 wherein said cheek members each include an oblique shoulder facing outwardly thereof, and pushing means for bearing against said oblique shoulders to urge the same against the supply roll and toward each other to hold the knife therebetween.

6. Apparatus according to claim 1, wherein said supply roller is carried in a cradle that is supported in a frame for pivotal movement about an axis spaced from the axes of said supply roller and of said inking roller, and pushing means operable for pivoting said cradle relative to said inking roller to provide desired contact between said inking roller and said supply roller.

7. Apparatus according to claim 1, wherein said supply roller is driven from the inking roller through a variable speed transmission means to permit the supply roller to be driven at a desired speed relative to the inking roller.

8. Apparatus according to claim 1, including an equalizing roller in surface contact with said supply roller for providing an ink layer of uniform thickness.

9. Apparatus according to claim 8, wherein said equalizing roller is in simultaneous surface contact with each of said supply roller and said inking roller.

10. Apparatus according to claim 1, including an equalizing roller in surface contact with said inking roller for providing an ink layer of uniform thickness.

11. Apparatus according to claim 9, wherein said equalizing roller is driven at a peripheral speed different from the peripheral speed of said supply roller.

* * * * *

UNITED STATES PATENT AND TRADEMARK OFFICE

CERTIFICATE OF CORRECTION

PATENT NO. : 4,542,693

DATED : September 24, 1985

INVENTOR(S) : GEORGES MOURRELLON

It is certified that error appears in the above-identified patent and that said Letters Patent is hereby corrected as shown below:

On The Title page:

Line [76], change inventor's last name to read --MOURRELLON--.

Signed and Sealed this

*Third* Day of *June 1986*

[SEAL]

*Attest:*

DONALD J. QUIGG

*Attesting Officer*

*Commissioner of Patents and Trademarks*